US006864216B2

(12) United States Patent
Weidner et al.

(10) Patent No.: US 6,864,216 B2
(45) Date of Patent: Mar. 8, 2005

(54) THERMAL MAGENTA DONOR AND DYES

(75) Inventors: Charles H. Weidner, Ontario, NY (US); Linda A. Kaszczuk, Webster, NY (US); Derek D. Chapman, Rochester, NY (US); Ruizheng Wang, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 201 days.

(21) Appl. No.: 10/223,123

(22) Filed: Aug. 19, 2002

(65) Prior Publication Data

US 2003/0232724 A1 Dec. 18, 2003

Related U.S. Application Data

(63) Continuation-in-part of application No. 10/153,569, filed on May 22, 2002.

(51) Int. Cl.[7] ..... B41M 5/035; B41M 5/38

(52) U.S. Cl. ..... 503/227

(58) Field of Search ..... 8/471; 503/227; 106/31.27, 31.46, 31.47, 31.49, 31.5

(56) References Cited

U.S. PATENT DOCUMENTS 5,023,229 A 6/1991 Evans et al.
5,866,509 A 2/1999 Chapman et al.

*Primary Examiner*—Bruce H. Hess
(74) *Attorney, Agent, or Firm*—Kathleen Neuner Manne; Chris P. Konkol

(57) ABSTRACT

Disclosed is a thermal dye transfer imaging donor element and a dye combination comprising a combination of dyes including a magenta dye and a yellow dye exhibiting an RMS error of less than 0.015.

25 Claims, No Drawings

THERMAL MAGENTA DONOR AND DYES

CROSS-REFERENCE TO RELATED APPLICATIONS

This application is a Continuation-in-Part of commonly assigned U.S. Ser. No. 10/153,569 filed May 22, 2002, the contents of which are incorporated herein by reference. This application is also related to the subject matter of U.S. Ser. No. 10/152,859, filed May 22, 2002 and U.S. Ser. No. 10/153,536, filed May 22, 2004.

FIELD OF THE INVENTION

This invention relates to a magenta thermal dye donor element and to a dye combination for better spectral match to target printing inks, comprising a combination of a magenta dye and one or more yellow image dyes which is used to obtain a color proof that accurately represents the hue of a printed color image obtained from a printing press.

BACKGROUND OF THE INVENTION

In order to approximate the appearance of continuous tone (photographic) images via ink-on-paper printing, the commercial printing industry relies on the process known as halftone printing. In halftone printing, color density gradations are produced by printing patterns of dots or areas of varying sizes, but of the same color density, instead of varying the color density continuously as is done in photographic printing.

There is an important commercial need to obtain a color proof image before a printing press run is made. It is desired that the color proof will accurately represent at least the details and color tone scale of the prints obtained from the printing press. In many cases, it is also desirable that the color proof accurately represents the image quality and halftone pattern of the prints obtained on the printing press. In the sequence of operations necessary to produce an ink-printed, full color picture, a proof is also required to check the accuracy of the color separation data from which the final three or more printing plates or cylinders are made. Traditionally, such color separations proofs have involved silver halide light-sensitive systems which require many exposure and processing steps before a final, full color picture is assembled.

Colorants that are used in the printing industry are insoluble pigments. By virtue of their pigment character, the spectrophotometric curves of the printing inks are often unusually sharp on either the bathochromic or hypsochromic side. This can cause problems in color proofing systems in which dyes, as opposed to pigments, are being used. It is very difficult to match the hue of a given ink using a single dye.

In U.S. Pat. No. 5,126,760, a process is described for producing a direct digital, halftone color proof of an original image on a dye-receiving element. The proof can then be used to represent a printed color image obtained from a printing press. The process described therein comprises:

a) generating a set of electrical signals which is representative of the shape and color scale of an original image;

b) contacting a dye-donor element comprising a support having thereon a dye layer and an infrared-absorbing material with a first dye-receiving element comprising a support having thereon a polymeric, dye image-receiving layer;

c) using the signals to image-wise heat by means of a diode laser the dye-donor element, thereby transferring a dye image to the first dye-receiving element; and d) re-transferring the dye image to a second dye image-receiving element which has the same substrate as the printed color image. In the above process, multiple dye-donors are used to obtain a complete range of colors in the proof For example, for a full color proof, four colors—cyan, magenta, yellow and black are normally used.

By using the above process, the image dye is transferred by heating the dye-donor containing the infrared-absorbing material with the diode laser to volatilize the dye, the diode laser beam being modulated by the set of signals which is representative of the shape and color of the original image, so that the dye is heated to cause volatilization only in those areas in which its presence is required on the dye-receiving layer to reconstruct the original image.

Similarly, a thermal transfer proof can be generated by using a thermal print head in place of a diode laser as described in U.S. Pat. No. 4,923,846. Commonly available thermal heads are not capable of generating halftone images of adequate resolution, but can produce high quality continuous tone proof images, which are satisfactory in many instances. U.S. Pat. No. 4,923,846 also discloses the choice of mixtures of dyes for use in thermal imaging proofing systems. Inkjet is also used as a low cost proofing method as described in U.S. Pat. No. 6,022,440. Likewise, an inkjet proof can be generated using combinations of either dispersed dyes in an aqueous fluid, or dissolved dyes in a solvent based system. U.S. Pat. No. 6,352,330 discloses methods for accomplishing this. Ink jet printers can also produce high quality continuous tone proof images, which by virtue of their cost are satisfactory in many instances. The dyes are selected on the basis of values for hue error and turbidity. The Graphic Arts Technical Foundation Research Report No. 38, "Color Material" (58-(5) 293–301, 1985) gives an account of this method.

An alternative and more precise method for color measurement and analysis uses the concept of uniform color space known as CIELAB, in which a sample is analyzed mathematically in terms of its spectrophotometric curve, the nature of the illuminant under which it is viewed, and the color vision of a standard observer. For a discussion of CIELAB and color measurement, see *Principles of Color Technology*, $2^{nd}$ Edition, F. W. Billmeyer, pp. 25–110, Wiley Interscience and *Optical Radiation Measurements*, Volume 2, F. Grum, pp. 33–145, Academic Press.

In using CIELAB, colors can be expressed in terms of three parameters: L*, a*, and b*, where L* is a lightness function, and a* and b* define a point in color space. Thus, a plot of a* vs b* values for a color sample can be used to accurately show where that sample lies in color space, i.e., what its hue is. This allows different samples to be compared for hue if they have similar density and L* values.

In U.S. Pat. No. 5,023,229, a mixture of a magenta dye and a yellow dye is described for color proofing. However, there may be a problem in using this mixture in the U.S. in that an acceptable gray balance is not obtained when overprinted sequentially with certain yellow and cyan thermal transfer dyes. There is another problem with using that mixture in color proofs for Japan, in that the colorimetry is not as good a match to the color standards as one would desire.

In U.S. Pat. No. 5,866,509, a mixture of two magenta dyes and a yellow dye is described for color proofing. Although this provides a closer match to the SWOP hue and to the Japan Color standards than the mixture used in U.S. Pat. No. 5,023,229, it is still not as good as one would desire.

In color proofing in the printing industry, it is important to be able to match the proofing ink references provided by the International Prepress Proofing Association. In the United States, these ink references are density patches made with standard 4-color process inks and are known as SWOP® (Specifications Web Offset Publications) color aims. A SWOP certified press sheet In 1995, ANSI CGATS TR 001-1995 was published which is becoming the standard in the United States industry. For additional information on color measurement of inks for web offset proofing, see "Advances in Printing Science and Technology", Proceedings of the 19th International Conference of Printing Research Institutes, Eisenstadt, Austria, June 1987, J. T Ling and R. Warner, p.55.

It is also desirable to provide proofs which can be used in parts of the world which do not use the SWOP® aims. For example, in Japan, a different standard is used and it would be desirable to provide a closer match to Japan Color. The 2001 Japan Color/Color Sample colorimetry values currently under consideration by the Japan National Committee for ISO/TC130 were used as the color reference.

It is a problem to be solved to provide dye combinations and thermal dye transfer donors that more accurately reproduce desired target colors.

SUMMARY OF THE INVENTION

The invention provides a thermal dye transfer imaging element comprising a magenta dye donor containing a combination of dyes including a magenta dye and a yellow dye exhibiting an RMS error of less than 0.015. The invention also provides a dye combination and a method of forming an image.

Embodiments of the invention more accurately reproduce desired target colors.

DETAILED DESCRIPTION OF THE INVENTION

It is an object of this invention to minimize the secondary color errors produced by dye combinations by selecting combinations so that the root mean square error of the dye combinations compared to their target aims is not more than a predetermined value. It is yet another object of this invention to provide a mixture of a magenta dye and one or more yellow dyes for color proofing wherein the colorimetry is improved. These objects are obtained as described in the summary of the invention above.

The root mean square error (or RMS error) here is defined as the summation of the differences between the "aim" spectral curve and the dye combination spectral curve to match it, divided by the number of data points used. It can be written as: RMS error=$\Sigma_{380\text{-}730}\ (d_{aim}-d_{exp})^2/(n)$ where n=36 in this case. This has been adapted from statistics texts and a good reference is "Applied Linear Statistical Models: Regression, Analysis of Variance and Experimental Designs"_ by John Neter, William Wasserman, Michael H. Kutner, second edition, 1985, by Richard D. Irwin, Inc.

In the broadest embodiment, the invention provides a combination of dyes that best reproduces target colors based on the RMS of the set of dyes. In another embodiment, this invention relates to dye combinations and elements containing them that comprise a magenta dye and a yellow dye. Suitably, the magenta dye is one having the formula I:

I

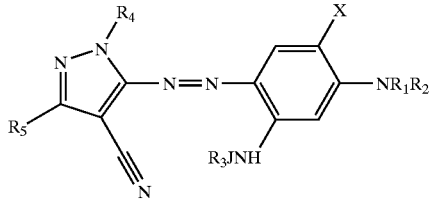

wherein:

$R_1$ is an alkyl or allyl group of from 1 to about 6 carbon atoms, such as methyl, ethyl, propyl, isopropyl, butyl, pentyl, allyl, but-2-en-1-yl, 1,1-dichloropropen-3-yl, including such alkyl or allyl groups substituted with groups such as hydroxy, acyloxy, alkoxy, aryl, carboxy, carbalkoxy, cyano, acylamido, halogen;

X is an alkoxy group of from 1 to about 4 carbon atoms or represents the atoms when taken together with $R_2$ forms a 5- or 6-membered ring;

$R_2$ is any of the groups as described for $R_1$ or represents the atoms which when taken together with X forms a 5- or 6-membered ring;

$R_3$ is an alkyl group of from 1 to 6 carbon atoms such as those listed above for $R_1$, or an aryl group of from about 6 to 10 carbon atoms such as phenyl, naphthyl, p-tolyl, m-chlorophenyl, p-methoxyphenyl, m-bromophenyl, and o-tolyl groups;

J is CO, $CO_2$, $SO_2$, or $CONR_5$;

$R_4$ is an alkyl or allyl group of from 1 to 6 carbon atoms, such as those listed above for $R_1$, or an aryl group of from 6 to 10 carbon atoms such as those listed above for $R_3$; and $R_5$ is hydrogen, an alkyl or allyl group of from 1 to 6 carbon atoms, such as those listed above for $R_1$, or an aryl group of from 6 to 10 carbon atoms such as those listed above for $R_3$.

The yellow dye is suitably at least one of those of formulas II or III:

II

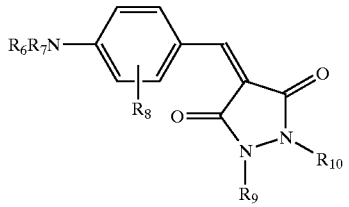

wherein:

$R_6$ is an alkyl or allyl group of from 1 to 6 carbon atoms, such as methyl, ethyl, propyl, isopropyl, butyl, pentyl, allyl, but-2-en-1-yl, 1,1-dichloropropen-3-yl, or such alkyl or allyl groups substituted with groups such as hydroxy, acyloxy, alkoxy, aryl, carboxy, carbalkoxy, cyano, acylamido, halogen, and phenyl;

$R_7$ is any of the groups as described for $R_6$, or represents the atoms which when taken together with $R_8$ forms a 5- or 6-membered ring;

$R_8$ is an alkyl or alkoxy group of from 1 to 6 carbon atoms, or represents the atoms which when taken together with $R_7$ forms a 5- or 6-membered ring group; and $R_9$ and $R_{10}$ are each an alkyl group of 1–6 carbon atoms, or an aryl group of from about 6 to 10 carbon atoms such as phenyl, naphthyl, p-tolyl, m-chlorophenyl, p-methoxyphenyl, m-bromophenyl, and o-tolyl groups.

III

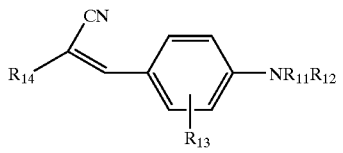

wherein:

$R_{11}$ is an alkyl or allyl group of from 1 to 6 carbon atoms, such as methyl, ethyl, propyl, isopropyl, butyl, pentyl, allyl, but-2-en-1-yl, 1,1-dichloropropen-3-yl, or such alkyl or allyl groups substituted with substituents such as hydroxy, acyloxy, alkoxy, aryl, carboxy, carbalkoxy, cyano, acylamido, halogen, and phenyl groups;

$R_{12}$ is any of the groups as described for $R_{11}$, or represents the atoms which when taken together with $R_{13}$ form a 5- or 6-membered ring group;

$R_{13}$ is an alkyl or alkoxy of from 1 to 6 carbon atoms, or represents the atoms which when taken together with $R_{12}$ form a 5- or 6-membered ring group;

$R_{14}$ is cyano, $C(O)OR_{15}$ or —$CONR_{15}R_{16}$, where $R_{15}$ and $R_{16}$ each independently represents an alkyl group having from 1 to 6 carbon atoms; a cycloalkyl group of from 5 to 7 carbon atoms; an allyl group; an aryl group of from 6 to 10 carbon atoms such as phenyl, naphthyl, p-tolyl, m-chlorophenyl, p-methoxyphenyl, m-bromophenyl, and o-tolyl; or a heteroaryl group of from 5 to 10 atoms, such as 2-thienyl, 2-pyridyl, or 2-furyl.

In some embodiments, the combination can include an additional dye of formula IV:

IV

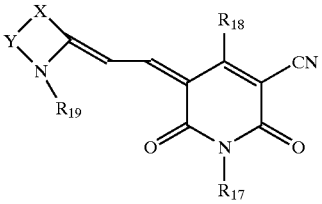

wherein:

$R_{17}$, $R_{18}$, and $R_{19}$ each independently represents an alkyl group having from 1 to 10 carbon atoms; a cycloalkyl group of from 5 to 7 carbon atoms; an allyl group; an aryl group of from 6 to 10 carbon atoms such as phenyl, naphthyl, p-tolyl, m-chlorophenyl, p-methoxyphenyl, m-bromophenyl,and o-tolyl; or a heteroaryl group of from 5 to 10 atoms, such as 2-thienyl, 2-pyridyl, or 2-furyl;

X represents $C(CH_3)_2$, S, O, or $NR_{17}$.

In a laser thermal dye donor element, the element includes an IR dye such as one of formula V:

V

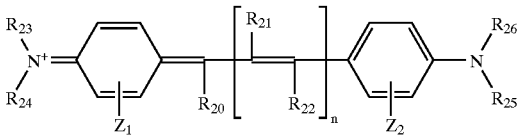

wherein:

$R_{20}$, $R_{21}$, and $R_{22}$ each independently represents hydrogen, halogen, cyano, alkoxy, aryloxy, acyloxy, aryloxycarbonyl, alkoxycarbonyl, sulfonyl, carbamoyl, acyl, acylamido, alkylamino, arylamino, or a substituted or unsubstituted alkyl, aryl, or a heteroaryl group; or any two of said $R_{20}$, $R_{21}$, and $R_{22}$ groups may be joined together or with an adjacent aromatic ring to complete a 5- to 7-membered carbocyclic or heterocyclic ring group;

$R_{23}$, $R_{24}$, $R_{25}$, and $R_{26}$ each independently represents hydrogen, an alkyl or cycloalkyl group having from 1 to 6 carbon atoms or an aryl or heteroaryl group having from about 5 to 10 atoms;

or $R_{23}$, $R_{24}$, $R_{25}$, and $R_{26}$ may be joined together to form a 5- to 7-membered heterocyclic ring;

or $R_{23}$, $R_{24}$, $R_{25}$, and $R_{26}$ may be joined to the carbon atom of the adjacent aromatic ring at a position ortho to the position of attachment of the anilino nitrogen to form, along with the nitrogen to which they are attached, a 5- or 6-membered heterocyclic ring group;

n is 1 to 5;

X is a monovalent anion; and $Z_1$ and $Z_2$ each independently represents $R_{20}$ or the atoms necessary to complete a 5- to 7-membered fused carbocyclic or heterocyclic ring.

In a preferred embodiment of the invention either of the following infrared-absorbing dyes are used:

V-a

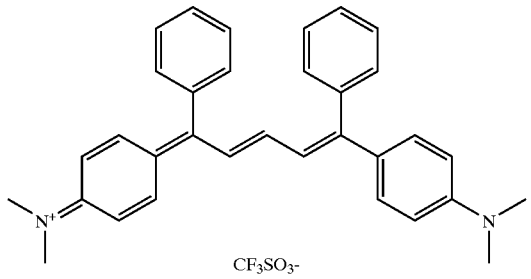

V-b

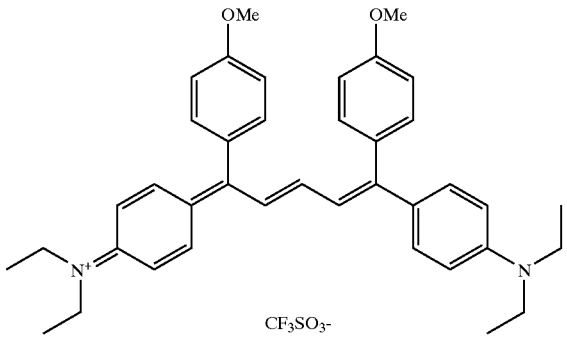

Useful magenta dyes of structure I included within the scope of the invention are as follows:

I

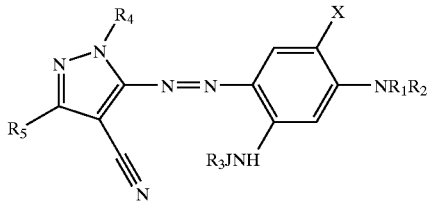

| Dye | $R_1$ | $R_2$ | $R_3$ | $R_4$ | $R_5$ | X | J |
|---|---|---|---|---|---|---|---|
| Ia | $C_2H_5$ | $C_2H_5$ | $CH_3$ | $CH_2CH(OH)CH_3$ | t-$C_4H_9$ | $OCH_3$ | CO |
| lb | $C_2H_5$ | $C_2H_5$ | $CH_3$ | $CH_3$ | t-$C_4H_9$ | $OCH_3$ | CO |
| Ic | $C_2H_5$ | $C_2H_5$ | t-$C_4H_9$ | $CH_3$ | $CH_3$ | $OCH_3$ | CO |
| Id | $C_3H_7$ | $C_3H_7$ | $CH_3$ | $CH_3$ | t-$C_4H_9$ | $OCH_3$ | CO |
| le | $C_2H_5$ | $C_2H_5$ | $CH_3$ | $CH_2CH_3$ | t-$C_4H_9$ | $OCH_2CH_3$ | $SO_2$ |
| If | $C_2H_5$ | $C_2H_5$ | $C_2H_5$ | $CH_3$ | $CH_3$ | $OCH_2CH_3$ | CO |
| Ig | $C_2H_5$ | $C_3H_7$ | $CH_3$ | $CH_3$ | t-$C_4H_9$ | $OCH_3$ | CO |
| Ih | $C_2H_5$ | $C_2H_5$ | $CH_3$ | $CH_3$ | t-$C_4H_9$ | $OCH_3$ | $CO_2$ |
| Ij | $C_2H_5$ | $C_2H_5$ | $C_6H_5$ | $C_3H_7$ | t-$C_4H_9$ | $OCH_2CH_3$ | $SO_2$ |
| Ik | $CH_2CH{=}CH_2$ | $CH_2CH{=}CH_2$ | $CH_3$ | $CH_2C_6H_5$ | t-$C_4H_9$ | $OCH_3$ | CO |
| Im | $C_3H_7$ | $C_3H_7$ | $C_2H_5$ | $C_2H_5$ | $CH_3$ | $OC_3H_7$ | CO |
| In | $C_3H_7$ | $C_3H_7$ | $C_2H_5$ | $C_2H_5$ | $CH_3$ | $OC_3H_7$ | $SO_2$ |
| Io | $C_2H_5$ | $C_2H_5$ | $CH_3$ | $CH_2C(O)OC_2H_5$ | t-$C_4H_9$ | $OCH_3$ | CO |
| Ip | $C_2H_5$ | $C_2H_5$ | $CH_3$ | $CH_2C(O)OC_3H_7$ | t-$C_4H_9$ | $OCH_3$ | CO |

Iq

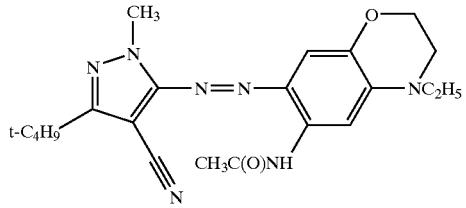

Ir

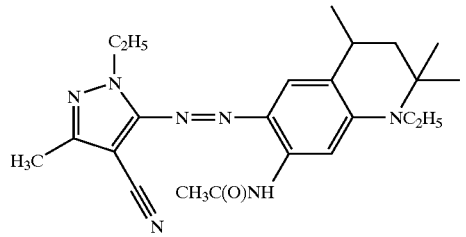

The above dyes and synthetic procedures for making these are disclosed in U.S. Pat. No. 3,336,285, GB 1,566,985, DE 2,600,036 and Dyes and Pigments, Vol 3, 81 (1982), the disclosures of which are hereby incorporated by reference.

Useful yellow dyes within the scope of formula II include the following:

II

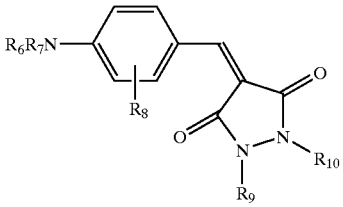

| Dye | $R_6$ | $R_7$ | $R_8$ | $R_9$ | $R_{10}$ |
|---|---|---|---|---|---|
| IIa | $C_2H_5$ | $C_2H_5$ | H | $C_6H_5$ | $C_2H_5$ |
| IIb | $C_2H_5$ | —$C(CH_3)_2CH_2CH(CH_3)$— | | $C_6H_5$ | $C_2H_5$ |

-continued

II

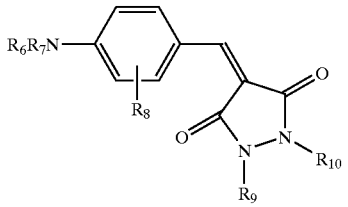

| Dye | $R_6$ | $R_7$ | $R_8$ | $R_9$ | $R_{10}$ |
|---|---|---|---|---|---|
| IIc | $CH_3$ | $CH_3$ | 2-$CH_3$ | $C_6H_5$ | $C_2H_5$ |
| IId | $CH_2C_6H_5$ | $CH_2C_6H_5$ | H | $C_6H_5$ | $C_2H_5$ |
| IIe | $C_2H_5$ | $C_2H_5$ | H | $C_6H_5$ | $C_4H_9$ |
| IIf | $C_2H_5$ | $C_2H_5$ | H | $C_6H_5$ | $CH_2CH{=}CH_2$ |
| IIg | $C_2H_5$ | $C_2H_5$ | H | $C_6H_5$ | $CH_2CH_2C(O)OCH_3$ |
| IIh | $C_2H_5$ | $C_2H_5$ | H | $C_6H_5$ | $CH_2C(O)OCH_2CH_3$ |

Useful yellow dyes within the scope of formula III include the following:

III

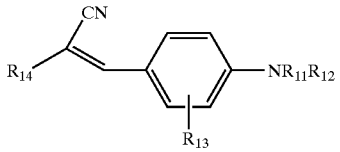

| Dye | $R_{11}$ | $R_{12}$ | $R_{13}$ | $R_{14}$ |
|---|---|---|---|---|
| IIIa | $C_2H_5$ | $C_2H_5$ | H | CN |
| IIIb | $C_2H_5$ | $C_2H_5$ | 2-$CH_3$ | CN |
| IIIc | $CH_2C_6H_5$ | $CH_2C_6H_5$ | H | CN |
| IIId | $C_2H_5$ | —$C(CH_3)_2CH_2CH(CH_3)$— | | CN |
| IIIe | $C_2H_5$ | $CH_2C_6H_5$ | H | CN |
| IIIf | $C_2H_5$ | $CH_2C_6H_5$ | H | $C(O)NHCH_2C_6H_5$ |
| IIIg | $C_2H_5$ | $C_2H_5$ | H | $C(O)NHCH_2C_6H_5$ |
| IIIh | $CH_2C_6H_5$ | $CH_2C_6H_5$ | H | $C(O)NHCH_2C_6H_5$ |
| IIIj | $CH_2C_6H_5$ | $CH_2C_6H_5$ | H | $C(O)N(C_2H_5)CH_2C_6H_5$ |
| IIIk | $C_2H_5$ | $C_2H_5$ | H | $C(O)OCH_2C_6H_5$ |
| IIIm | $C_2H_5$ | $C_2H_5$ | H | $C(O)OCH_2CH_3$ |
| IIIn | $CH_2C_6H_5$ | $CH_2C_6H_5$ | H | $C(O)OCH_2CH_3$ |
| IIIo | $C_2H_5$ | $CH_2C_6H_5$ | H | $C(O)OCH_2CH_3$ |
| IIIp | $CH_2C(O)OC_2H_5$ | $CH_2C(O)OC_2H_5$ | H | CN |

The above dyes and synthetic procedures for making these are disclosed in U.S. Pat. No. 3,247,211 and U.S. Pat. No. 5,081,101, the disclosure of which are hereby incorporated by reference.

Useful additional dyes within the scope of formula IV include the following:

IV

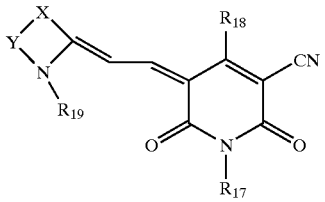

| Dye | $R_{17}$ | $R_{18}$ | $R_{19}$ | X | Y |
|---|---|---|---|---|---|
| IVa | $C_2H_5$ | $CH_3$ | $C_2H_5$ | S | $C_6H_4$ |
| IVb | $CH_2C_6H_5$ | $CH_3$ | $CH_3$ | S | $C_6H_4$ |

-continued

IV

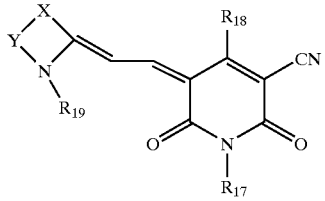

| Dye | $R_{17}$ | $R_{18}$ | $R_{19}$ | X | Y |
|---|---|---|---|---|---|
| IVc | $C_4H_9$ | $C_2H_5$ | $C_3H_7$ | $C(CH_3)_2$ | $C_6H_4$ |
| IVd | $C_2H_4OCH_3$ | $CH_3$ | $C_4H_9$ | $C(CH_3)_2$ | $C_6H_4$ |
| IVe | $C_4H_9$ | $C_2H_5$ | $C_4H_9$ | $C(CH_3)_2$ | $C_6H_4$ |
| IVf | $C_2H_4OC_2H_5$ | $CH_3$ | $C_2H_5$ | $C(CH_3)_2$ | $C_6H_4$ |
| IVe | $CH_2C_6H_5$ | $CH_3$ | $CH_3$ | $C(CH_3)_2$ | $C_6H_4$ |

The above dyes and synthetic procedures for making these are disclosed in JP 53/014734, the disclosure of which is hereby incorporated by reference.

Useful infrared absorbing materials of structure V are disclosed in U.S. Pat. No. 4,950,639, columns 3–7, the disclosure of which is hereby incorporated. Dyes of structure Va and Vb disclosed above and related structures are also useful.

Beside the foregoing objectives, it is also desirable for the dye-donor element to be stable to environmental conditions to which it may be subjected to during use.

Unless otherwise specifically stated, use of the term "group", "substituted" or "substituent" means any group or radical other than hydrogen. Additionally, when reference is made in this application to a compound or group that contains a substitutable hydrogen, it is also intended to encompass not only the unsubstituted form, but also its form further substituted with any substituent group or groups as herein mentioned, so long as the substituent does not destroy properties necessary for the intended utility. Suitably, a substituent group may be halogen or may be bonded to the remainder of the molecule by an atom of carbon, silicon, oxygen, nitrogen, phosphorous, or sulfur. The substituent may be, for example, halogen, such as chloro, bromo or fluoro; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, cyclohexyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired desirable properties for a specific application and can include, for example, hydrophobic groups, solubilizing groups, blocking groups, and releasing or releasable groups. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

The following examples are provided to illustrate the invention.

EXAMPLE 1

Individual magenta dye-donor elements were prepared by coating on a 100 $\mu$m poly(ethylene terephthalate) support a dye layer containing a mixture of a magenta dye, one or more yellow dyes, the infrared-absorbing bis(aminoaryl) polymethine dye as described in U.S. Pat. No. 4,950,639 (column 2 lines 3–68 and column 3 lines 1–3) at 0.046 g/m$^2$ in a polyvinylbutyral binder (BS18 from Wacker Chemie) at 0.46 g/m$^2$. The following experimental ratios shown in Table 1 were used in laydowns as listed:

TABLE 1

| Magenta Dye-Donor | Magenta Dye Ia (wt %) | Yellow Dye IIIf (wt %) | Yellow Dye IIg (wt %) | IR Dye | Dry Coverage (g/m$^2$) |
|---|---|---|---|---|---|
| M-1 | 94.1 | 5.9 | 0 | IV-b | 0.368 |
| M-2 | 88.6 | 11.4 | 0 | IV-b | 0.379 |
| M-3 | 85.7 | 14.3 | 0 | IV-b | 0.453 |
| M-4 | 84.2 | 15.8 | 0 | IV-b | 0.409 |
| M-5 | 93.9 | 2.8 | 3.3 | IV-b | 0.378 |

TABLE 1-continued

| Magenta Dye-Donor | Magenta Dye Ia (wt %) | Yellow Dye IIIf (wt %) | Yellow Dye IIg (wt %) | IR Dye | Dry Coverage (g/m$^2$) |
|---|---|---|---|---|---|
| M-6 | 91.0 | 5.5 | 3.4 | IV-b | 0.390 |
| M-7 | 93.4 | 2.8 | 3.8 | IV-b | 0.381 |
| M-8 | 92.8 | 3.5 | 3.7 | IV-b | 0.382 |
| M-9 | 85.7 | 14.3 | 0 | IV-b | 0.390 |
| M-10 | 85.7 | 13.2 | 1.1 | IV-a | 0.490 |
| M-11 | 86.8 | 7.9 | 5.3 | IV-a | 0.393 |

Control 1 for comparative purposes was Kodak Approval® Magenta Digital Color Proofing Film, CAT#8160459.

An intermediate dye-receiving element, Kodak Approval® Intermediate Color Proofing Film, CAT#1067560, was used with the above dye-donor elements to print an image. For the monochrome magenta images, the power to the laser array was modulated to produce a continuous tone image of uniform exposure steps of varying density as described in U.S. Pat. No. 4,876,235. After the exposure, the intermediate receiver was laminated to Tokuryo Art (Mitsubishi) paper which had been previously laminated with Kodak Approval® Prelaminate, P01.

All measurements of the magenta images were made using an X-Rite 938 portable spectrophotometer set for $D_{50}$ illuminant and 20 observer angle. Readings were made with black backing behind the samples. The CIELAB L* a* b* coordinates reported are interpolated to a Status T density of 1.60.

The color differences between the samples can be expressed as ΔE, where ΔE is the vector difference in CIELAB color space between the laser thermal generated image and the Japan Color aim.

$$\Delta E=\sqrt{((L^*_e-L^*_s)^2+(a^*_e-a^*_s)^2+(b^*_e-b^*_s)^2)}$$

Hue angle=360-arctan $b^*/a^*$ for negative values of b*=arctan $b^*/a^*$ for positive values of $b^*$ wherein subscript e represents the measurements from the experimental materials and subscript s represents the measurements from the Japan Color aim.

Table 2 summarizes the results obtained. The 2001 Japan Color/Color Sample colorimetry values currently under consideration by the Japan National Committee for ISO/TC130 were used as the color reference.

TABLE 2

| Magenta Dye-Donor | L* | a* | b* | ΔE | Hue Angle | ΔHue Angle |
|---|---|---|---|---|---|---|
| Japan Color | 46.6 | 75.1 | −4.4 | — | 356.6 | — |
| M-1 | 46.2 | 74.8 | −3.0 | 1.2 | 357.7 | 1.1 |
| M-2 | 46.2 | 75.4 | −5.4 | 1.15 | 355.9 | −0.7 |
| M-3 | 46.2 | 75.2 | −4.2 | 0.44 | 356.8 | 0.2 |
| M-4 | 46.3 | 74.9 | −3.4 | 1.07 | 357.4 | 0.8 |
| M-5 | 46.1 | 75.6 | −3.3 | 1.32 | 357.5 | 0.9 |
| M-6 | 46.1 | 75.3 | −3.3 | 1.26 | 357.5 | 0.9 |
| M-7 | 46.1 | 75.4 | −2.7 | 1.81 | 358 | 1.4 |
| M-8 | 46.1 | 75.5 | −3.3 | 1.31 | 357.5 | 0.9 |
| M-9 | 46.4 | 75.5 | −4.5 | 0.39 | 356.6 | 0 |
| M-10 | 46.4 | 75.5 | −3.6 | 0.93 | 357.3 | 0.7 |
| M-11 | 46.5 | 76.1 | −4.5 | 1.02 | 356.6 | 0 |
| Control 1* | 47.5 | 75.2 | 0.3 | 4.80 | 1.1 | 4.5 |

*Kodak Approval ® Magenta Digital Color Proofing Film, CAT# 8160459.

As can be seen by comparison of the control from Table 2, the inventive examples provide a closer match to the Japan Color aims (ΔE) while maintaining a good match in hue angle. A ΔE of 1 is sufficient to provide a just noticeable difference.

The L* a* b* color match can be achieved with a multitude of dye blends. The best secondary color reproduction, however, was achieved by best matching the spectral characteristics of the targets using the RMS values.

EXAMPLE 2

Individual magenta dye-donor elements were prepared by coating on a 100 μm poly(ethylene terephthalate) support a dye layer containing a mixture of a magenta dye, one or more yellow dyes, the infrared-absorbing bis(aminoaryl) polymethine dye as described in U.S. Pat. No. 4,950,639 (column 2 lines 3–68 and column 3 lines 1–3) at 0.054 g/m$^2$ in a polyvinylbutyral binder (Butvar B-72) at 0.463 g/m$^2$. The following experimental ratios shown in Table 1 were used in laydowns as listed:

TABLE 3

| Magenta Dye-Donor | Dye $I_o$ (wt %) | Dye $III_p$ (wt %) | Dye $II_g$ (wt %) | Dry Dye $IV_d$ (wt %) | IR Dye | Cov. (g/m$^2$) |
|---|---|---|---|---|---|---|
| M-12 | 73.5 | 9.0 | 8.5 | 9.0 | IV-b | 0.506 |

An intermediate dye-receiving element, Kodak Approval® Intermediate Color Proofing Film, CAT#1067560, was used with the above dye-donor element to print an image as in Examples 1–11. After the exposure, the intermediate receiver was laminated to both Tokuryo Art paper which had been previously laminated with Kodak Approval® Prelaminate, P01 and 60# TextWeb ™(Deferient Paper Company) paper which had been previously laminated with Kodak Approval® Prelaminate, P02.

The Japan Color comparison measurements of the magenta image were made using an X-Rite 938 portable spectrophotometer set for $D_{50}$ illuminant and 2° observer angle. The SWOP comparison measurements of the magenta image were made using a Gretag SPM100 portable spectrophotometer set for $D_{50}$ illuminant and 2° observer angle. All readings were made with black backing behind the samples. The CIELAB L* a* b* coordinates reported are interpolated to a Status T density of 1.52 for comparison to the Japan aim and to a Status T density of 1.41 for comparison with a SWOP certified press sheet (00–15–162), and at a 1.30 Status T density for comparison against the publication ANSI-CGATS TR 001-1995, which used a comparable lower magenta density.

TABLE 4

| Magenta Dye-Donor | L* | a* | b* | ΔE | Hue Angle | ΔHue Angle |
|---|---|---|---|---|---|---|
| Japan Press Sheet | 46.76 | 75.31 | −4.45 | — | 356.62 | — |
| M-12 | 46.74 | 74.68 | −4.47 | 0.63 | 356.57 | −0.05 |
| C-2 | 46.94 | 72.23 | 5.42 | 10.34 | 364.29 | 7.67 |
| C-1 | 48.69 | 74.56 | −0.27 | 4.7 | 359.8 | 3.18 |
| SWOP Certified Press Sheet 00-15-162 | 46.37 | 70.16 | −1.64 | — | 358.66 | — |
| M-12 | 46.71 | 70.45 | −1.23 | 0.61 | 359.00 | 0.34 |
| C-2 | 47.35 | 69.42 | 3.47 | 5.26 | 362.86 | 4.20 |
| C-1 | 49.11 | 71.31 | −2.00 | 2.99 | 358.40 | −0.26 |
| ANSI CGATS | 47.16 | 68.06 | −3.95 | — | 356.68 | — |

TABLE 4-continued

| Magenta Dye-Donor | L* | a* | b* | ΔE | Hue Angle | ΔHue Angle |
|---|---|---|---|---|---|---|
| TR001 1995 | | | | | | |
| M-12 | 48.30 | 68.25 | −3.42 | 1.27 | 357.13 | 0.45 |
| C-2 | 48.95 | 67.35 | 0.92 | 4.59 | 360.79 | 4.11 |
| C-1 | 50.59 | 69.20 | −3.72 | 3.62 | 356.93 | 0.25 |

As can be seen by comparison to the controls, the inventive examples show better match to color (small ΔE) while still maintaining good hue angle.

EXAMPLE 3

Individual magenta dye-donor elements were prepared by coating on a 100 μm poly(ethylene terephthalate) support a dye layer containing a mixture of a magenta dye, one or more yellow dyes, the infrared-absorbing bis(aminoaryl) polymethine dye as described in U.S. Pat. No. 4,950,639 (column 2 lines 3–68 and column 3 lines 1–3) at 0.054 g/m$^2$ in a polyvinylbutyral binder (Butvar B-72) at 0.463 g/m$^2$. The following experimental ratio shown in Table 5 was used in laydowns as listed:

TABLE 5

| Magenta Dye-Donor | Dye $I_o$ (wt %) | Dye $III_p$ (wt %) | Dye $II_g$ (wt %) | Dye $IV_d$ (wt %) | IR Dye | Dry Cov. (g/m$^2$) |
|---|---|---|---|---|---|---|
| M-13 | 76.2 | 19.0 | 4.8 | 0.0 | IV-b | 0.452 |

An intermediate dye-receiving element, Kodak Approval® Intermediate Color Proofing Film, CAT# 1067560, was used with the above dye-donor element to print an image as in the examples 1 and 2 above. After the exposure, the intermediate receiver was laminated 60# TextWeb ™(Deferient Paper Company) paper which had been previously laminated with Kodak Approval® Prelaminate, P02. The following results were achieved in Table 6:

TABLE 6

| Magenta Dye-Donor | L* | a* | b* | ΔE | Hue Angle | ΔHue Angle |
|---|---|---|---|---|---|---|
| SWOP Certified Press Sheet 00-15-162 | 46.37 | 70.16 | −1.64 | — | 358.66 | — |
| M-13 | 45.88 | 69.70 | −1.63 | 0.67 | 358.66 | 0.00 |
| C-2 | 47.35 | 69.42 | 3.47 | 5.26 | 362.86 | 4.20 |
| C-1 | 49.11 | 71.31 | −2.00 | 2.99 | 358.40 | −0.26 |
| ANSI CGATS TR001 1995 | 47.16 | 68.06 | −3.95 | — | 356.68 | — |
| M-13 | 47.62 | 67.71 | −3.88 | 0.56 | 356.72 | 0.04 |
| C-2 | 48.95 | 67.35 | 0.92 | 4.59 | 360.79 | 4.11 |
| C-1 | 50.59 | 69.20 | −3.72 | 3.62 | 356.93 | 0.25 |

As can be seen again by comparison to the controls, the inventive examples show better match to color (small ΔE) while still maintaining good hue angle.

The above cited examples were also compared in terms of RMS Error against the "target" specified color aims, using the earlier defined formula. The results are summarized below in Table 7.

TABLE 7

| Magenta Examples | RMS Error for Japan Color |
|---|---|
| M-1 | 0.01264 |
| M-2 | 0.01001 |
| M-3 | 0.01016 |
| M-4 | 0.01197 |
| M-5 | 0.01331 |
| M-6 | 0.01164 |
| M-7 | 0.01443 |
| M-8 | 0.01262 |
| M-12 | 0.01009 |
| C-1 | 0.02986 |

As can be seen from the data above, examples of the invention display a smaller RMS error which accurately predicts a closer spectral match to the target ink aims.

A similar comparison was run for the SWOP certified Press Aim in Table 8 below:

TABLE 8

| Magenta Examples | RMS Error for SWOP Certified Press Sheet 00-15-162 |
|---|---|
| M-12 | 0.00523 |
| M-13 | 0.01286 |
| C-1 | 0.01778 |

As can be seen from the data above, examples of the invention display a smaller RMS error, thus providing a closer spectral match to the target ink aims.

The entire contents of the patents and other publications referred to in this specification are incorporated herein by reference.

What is claimed is:

1. A thermal dye transfer imaging element comprising a magenta dye donor containing a combination of dyes including a magenta dye and a yellow dye exhibiting an RMS error of less than 0.015, wherein the yellow dye is a dye of formula III:

III

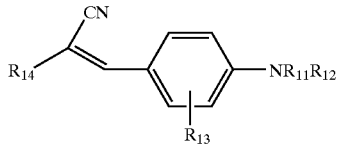

wherein:

$R_{11}$ is an alkyl or allyl group of from 1 to 6 carbon atoms;

$R_{12}$ is any of the groups as described for $R_{11}$, or represents the atoms which when taken together with $R_{13}$ form a 5- or 6-membered ring group;

$R_{13}$ is an alkyl or alkoxy of from 1 to 6 carbon atoms, or represents the atoms which when taken together with $R_{12}$ form a 5- or 6-membered ring group; and $R_{14}$ is cyano, $C(O)OR_{15}$, or $—CONR_{15}R_{16}$, where $R_{15}$ and $R_{16}$ each independently represents an alkyl group having from 1 to 6 carbon atoms; a cycloalkyl group of from 5 to 7 carbon atoms; an allyl group; or an aryl group of from 6 to 10 carbon atoms.

2. The element of claim 1 wherein the RMS error is less than 0.010.

3. The element of claim 2 wherein the RMS error is less than 0.008.

4. The element of claim 1 wherein the magenta dye is a phenylazopyrazole dye.

5. The element of claim 4 wherein the magenta dye is represented by formula I:

I

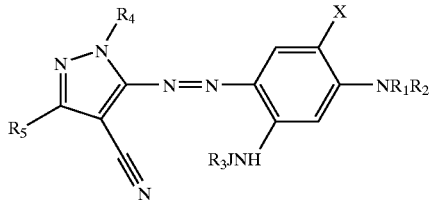

wherein:

$R_1$ is an alkyl or allyl group of from 1 to 6 carbon atoms;

X is an alkoxy group of from 1 to about 4 carbon atoms or represents the atoms when taken together with $R_2$ forms a 5- or 6-membered ring group;

$R_2$ is any of the groups as described for $R_1$ or represents the atoms which when taken together with X forms a 5- or 6-membered ring group;

$R_3$ is an alkyl group of from 1 to about 6 carbon atoms or an aryl group of from about 6 to 10 carbon;

J is selected from the group consisting of CO, $CO_2$, $SO_2$, and $CONR_5$;

$R_4$ is an alkyl or allyl group of from 1 to 6 carbon atoms or an aryl group of from 6 to 10 carbon atoms; and $R_5$ is hydrogen, an alkyl or allyl group of from 1 to 6 carbon atoms, or an aryl group of from 6 to 10 carbon atoms.

6. The element of claim 5 wherein the magenta dye is one where each of $R_1$ through $R_5$ is an alkyl group and X is an alkoxy group.

7. The element of claim 1 wherein the yellow dye is one where each $R_{11}$ and $R_{12}$ is an alkyl group and $R_{14}$ is a cyano, carbamoyl, or alkoxycarbonyl group.

8. The element of claim 1 further containing a second yellow dye.

9. The element of claim 8 wherein the second yellow dye is a dye of Formula II:

II

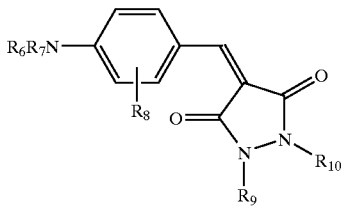

wherein:

$R_6$ is an alkyl or allyl group of from 1 to 6 carbon atoms;

$R_7$ is any of the groups as described for $R_6$, or represents the atoms which when taken together with $R_8$ form a 5- or 6-membered ring group;

$R_8$ is an alkyl or alkoxy group of from 1 to 6 carbon atoms, or represents the atoms which when taken together with $R_7$ forms a 5- or 6-membered ring group; and $R_9$ and $R_{10}$ are each an alkyl group of from 1 to 6 carbon atoms or an aryl group of from about 6 to 10 carbon atoms.

10. The element of claim 8 further including an additional dye of formula IV:

IV

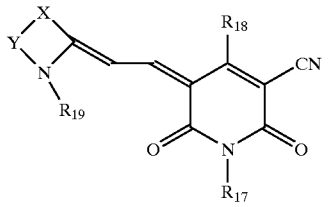

wherein:

$R_{17}$, $R_{18}$, and $R_{19}$ each independently represents an alkyl group having from 1 to 10 carbon atoms; a cycloalkyl group of from 5 to 7 carbon atoms; an allyl group; an aryl group of from 6 to 10 carbon atoms; or a heteroaryl group of from 5 to 10 atoms; and X represents $C(CH_3)_2$, S, O, or $NR_{17}$.

11. The element of claim 10 further comprising an IR dye.

12. The element of claim 11 wherein the IR dye is a dye of formula V:

V

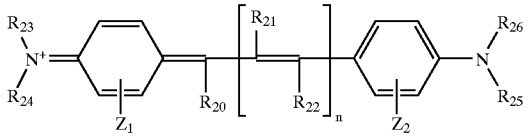

wherein:

$R_{20}$, $R_{21}$, and $R_{22}$ each independently represents hydrogen, halogen, cyano, alkoxy, aryloxy, acyloxy, aryloxycarbonyl, alkoxycarbonyl, sulfonyl, carbamoyl, acyl, acylamido, alkylamino, arylamino, alkyl, aryl, or a heteroaryl group; or any two of said $R_{20}$, $R_{21}$, and $R_{22}$ groups may be joined together or with an adjacent aromatic ring to complete a 5- to 7-membered carbocyclic or heterocyclic ring group;

$R_{23}$, $R_{24}$, $R_{25}$, and $R_{26}$ each independently represents hydrogen, an alkyl or cycloalkyl group having from 1 to 6 carbon atoms or an aryl or heteroaryl group having from about 5 to 10 atoms;

or $R_{23}$, $R_{24}$, $R_{25}$, and $R_{26}$ may be joined together to form a 5- to 7-membered heterocyclic ring;

or $R_{23}$, $R_{24}$, $R_{25}$, and $R_{26}$ may be joined to the carbon atom of the adjacent aromatic ring at a position ortho to the position of attachment of the anilino nitrogen to form, along with the nitrogen to which they are attached, a 5- or 6-membered heterocyclic ring group;

n is 1 to 5;

X is a monovalent anion; and $Z_1$ and $Z_2$ each independently represents $R_{20}$ or the atoms necessary to complete a 5- to 7-membered fused carbocyclic or heterocyclic ring.

13. A method of forming an image comprising imagewise transferring a dye from the element of claim 1 to a receiving element.

14. A thermal dye transfer imaging donor element comprising a magenta dye donor containing a combination of dyes including a magenta dye and two yellow dyes represented by formulas I, II, and III, respectively:

I

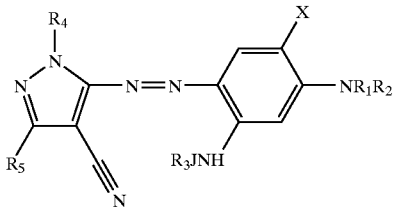

wherein:

$R_1$ is an alkyl or allyl group of from 1 to 6 carbon atoms;

X is an alkoxy group of from 1 to about 4 carbon atoms or represents the atoms when taken together with $R_2$ forms a 5- or 6-membered ring group;

$R_2$ is any of the groups as described for $R_1$ or represents the atoms which when taken together with X forms a 5- or 6-membered ring group;

$R_3$ is an alkyl group of from 1 to about 6 carbon atoms or aryl group of from about 6 to 10 carbon;

J is selected from the group consisting of CO, $CO_2$, $SO_2$, and $CONR_5$;

$R_4$ is an alkyl or allyl group of from 1 to 6 carbon atoms or an aryl group of from 6 to 10 carbon atoms; and $R_5$ is hydrogen, an alkyl or allyl group of from 1 to 6 carbon atoms, or an aryl group of from 6 to 10 carbon atoms;

II

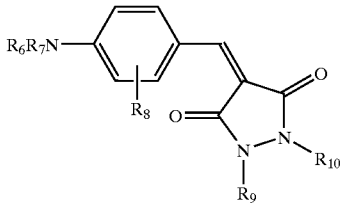

wherein:

$R_6$ is an alkyl or allyl group of from 1 to 6 carbon atoms;

$R_7$ is any of the groups as described for $R_6$, or represents the atoms which when taken together with $R_8$ form a 5- or 6-membered ring group;

$R_8$ is an alkyl or alkoxy group of from 1 to 6 carbon atoms, or represents the atoms which when taken together with $R_7$ forms a 5- or 6-membered ring group; and $R_9$ and $R_{10}$ are each an alkyl group of from 1 to 6 carbon atoms or an aryl group of from about 6 to 10 carbon atoms; and

III

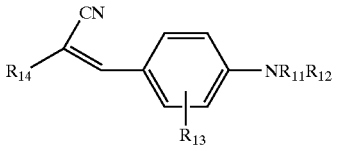

wherein:

$R_{11}$ is an alkyl or allyl group of from 1 to 6 carbon atoms;

$R_{12}$ is any of the groups as described for $R_{11}$, or represents the atoms which when taken together with $R_{13}$ form a 5- or 6-membered ring group;

$R_{13}$ is an alkyl or alkoxy of from 1 to 6 carbon atoms, or represent the atoms which when taken together with $R_{12}$ form a 5- or 6-membered ring group; and $R_{14}$ is cyano, $C(O)OR_{15}$, or $—CONR_{15}R_{16}$, where $R_{15}$ and $R_{16}$ each independently represents an alkyl group having from 1 to 6 carbon atoms; a cycloalkyl group of from 5 to 7 carbon atoms; an allyl group; or an aryl group of from 6 to 10 carbon atoms, and further comprising an additional dye of formula IV:

IV

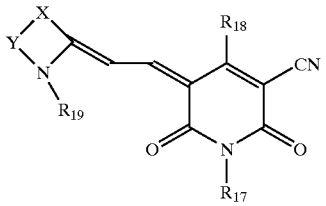

wherein:

$R_{17}$, $R_{18}$, and $R_{19}$ each independently represents an alkyl group having from 1 to 10 carbon atoms; a cycloalkyl group of from 5 to 7 carbon atoms; an allyl group; an aryl group of from 6 to 10 carbon atoms; or a heteroaryl group of from 5 to 10 atoms; and X represents $C(CH_3)_2$, S, O, or $NR_{17}$.

15. A combination of dyes useful for forming a magenta image comprising a magenta dye and a yellow dye exhibiting an RMS error of less than 0.015, wherein the yellow dye is a dye of formula III

III

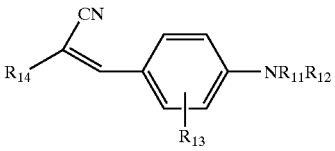

wherein:

$R_{11}$ is an alkyl or allyl group of from 1 to 6 carbon atoms;

$R_{12}$ is any of the groups as described for $R_{11}$, or represents the atoms which when taken together with $R_{13}$ form a 5- or 6-membered ring group;

$R_{13}$ is an alkyl or alkoxy of from 1 to 6 carbon atoms, or represents the atoms which when taken together with $R_{12}$ form a 5- or 6-membered ring group; and $R_{14}$ is cyano or $—CONR_{15}R_{16}$, where $R_{15}$ and $R_{16}$ each independently represents an alkyl group having from 1 to 6 carbon atoms; a cycloalkyl group of from 5 to 7 carbon atoms; an allyl group; or an aryl group of from 6 to 10 carbon atoms.

16. The combination of claim 15 wherein the RMS error is less than 0.010.

17. The combination of claim 16 wherein the RMS error is less than 0.008.

18. The combination of claim 15 wherein the magenta dye is a phenylazopyrazole dye.

19. The combination of claim 15 wherein the magenta dye is represented by formula I:

I

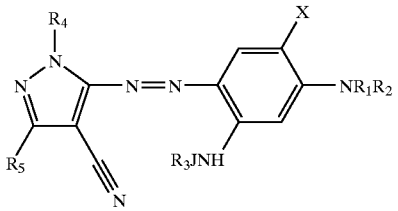

wherein:

$R_1$ is an alkyl or allyl group of from 1 to 6 carbon atoms;

X is an alkoxy group of from 1 to about 4 carbon atoms or represents the atoms when taken together with $R_2$ forms a 5- or 6-membered ring group;

$R_2$ is any of the groups as described for $R_1$ or represents the atoms which when taken together with X forms a 5- or 6-membered ring group;

$R_3$ is an alkyl group of from 1 to about 6 carbon atoms or an aryl group of from about 6 to 10 carbon;

J is selected from the group consisting of CO, $CO_2$, $SO_2$, and $CONR_5$;

$R_4$ is an alkyl or allyl group of from 1 to 6 carbon atoms or an aryl group of from 6 to 10 carbon atoms; and $R_5$ is hydrogen, an alkyl or allyl group of from 1 to 6 carbon atoms, or an aryl group of from 6 to 10 carbon atoms.

20. The combination of claim 19 wherein the magenta dye is one where each of $R_1$ through $R_5$ is an alkyl group and X is an alkoxy group.

21. The combination of claim 15 wherein the yellow dye is one where each $R_{11}$ and $R_{12}$ is an alkyl group and $R_{14}$ is a cyano, carbamoyl, or alkoxycarbonyl group.

22. The combination of claim 15 further containing a second yellow dye.

23. The combination of claim 22 wherein the second yellow dye is a dye of Formula II

II

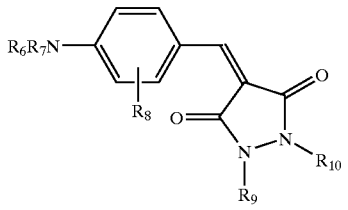

wherein:

$R_6$ is an alkyl or allyl group of from 1 to 6 carbon atoms;

$R_7$ is any of the groups as described for $R_6$, or represents the atoms which when taken together with $R_8$ form a 5- or 6-membered ring group;

$R_8$ is an alkyl or alkoxy group of from 1 to 6 carbon atoms, or represents the atoms which when taken together with $R_7$ forms a 5- or 6-membered ring group; and $R_9$ and $R_{10}$ are each an alkyl group of from 1 to 6 carbon atoms or an aryl group of from about 6 to 10 carbon atoms.

24. The combination of claim 23 further comprising an additional dye of formula IV:

IV

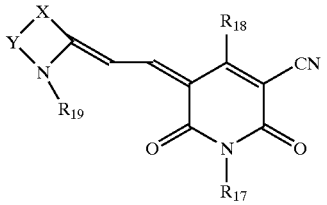

wherein:

$R_{17}$, $R_{18}$, and $R_{19}$ each independently represents an alkyl group having from 1 to 10 carbon atoms; a cycloalkyl group of from 5 to 7 carbon atoms; an allyl group; an aryl group of from 6 to 10 carbon; or a heteroaryl group of from 5 to 10 atoms; and X represents $C(CH_3)_2$, S, O, or $NR_{17}$.

25. The combination of claim 22 further comprising an additional dye of formula IV:

IV

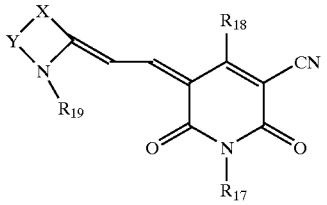

wherein:

$R_{17}$, $R_{18}$, and $R_{19}$ each independently represents an alkyl group having from 1 to 10 carbon atoms; a cycloalkyl group of from 5 to 7 carbon atoms; an allyl group; an aryl group of from 6 to 10 carbon; or a heteroaryl group of from 5 to 10 atoms; and X represents $C(CH_3)_2$, S, O, or $NR_{17}$.

* * * * *